United States Patent [19]

Shapero et al.

[11] Patent Number: 5,017,173

[45] Date of Patent: May 21, 1991

[54] TORSIONAL JOINT SKELETON FOR POSEABLE FIGURE

[75] Inventors: Wallace H. Shapero, West Hills; John Sneddon, Santa Monica, both of Calif.

[73] Assignee: Mattel, Inc., El Segundo, Calif.

[21] Appl. No.: 424,026

[22] Filed: Oct. 19, 1989

[51] Int. Cl.[5] ..... A63H 3/04; A63H 3/46; A63H 3/02

[52] U.S. Cl. ..... 446/374; 446/382; 446/370

[58] Field of Search ..... 446/373, 371, 372, 370, 446/369, 374, 375, 376, 378, 379, 380, 381, 382, 383, 330

[56] References Cited

U.S. PATENT DOCUMENTS

| | | | |
|---|---|---|---|
| 164,582 | 6/1875 | Miller | 446/373 |
| 1,189,585 | 7/1916 | Kruse | 446/374 |
| 1,422,840 | 7/1922 | De Grasse | 446/374 |
| 1,595,203 | 8/1926 | Leathers | 446/375 |
| 1,626,533 | 4/1927 | Hergershausen | 446/374 |
| 2,089,376 | 8/1937 | Jacobson | 446/374 |
| 2,118,677 | 5/1938 | Lower | 446/380 |
| 2,134,974 | 11/1938 | Hurwitz | 40/411 |
| 2,202,805 | 5/1940 | Wood | 446/374 |
| 2,219,130 | 10/1940 | Herrmann | 446/177 |
| 2,354,581 | 7/1944 | De Jong | 446/376 |
| 2,392,024 | 1/1946 | Gorui | 446/374 |
| 2,482,334 | 9/1949 | Fernald | 446/374 |
| 2,909,370 | 10/1959 | Fortney | 446/334 X |
| 3,234,689 | 2/1966 | Ryan | 446/380 |
| 3,277,601 | 10/1966 | Ryan | 446/378 |
| 3,284,947 | 11/1966 | Dahl | 446/374 |
| 3,296,737 | 1/1967 | Doyle et al. | 446/374 |
| 3,589,061 | 6/1971 | Bear | 446/382 |
| 3,605,330 | 9/1971 | Sivelle et al. | 446/382 |
| 3,940,880 | 3/1976 | Kaelin et al. | 446/381 |
| 4,062,144 | 12/1977 | Holden | 446/371 |
| 4,197,358 | 4/1980 | Garcia | 446/374 X |
| 4,571,209 | 2/1986 | Manning et al. | 446/376 X |
| 4,578,045 | 3/1986 | Mayer et al. | 446/330 |

FOREIGN PATENT DOCUMENTS

| | | | |
|---|---|---|---|
| 7207074 | 2/1972 | Fed. Rep. of Germany | 446/378 |
| 178748 | 4/1922 | United Kingdom | 446/374 |
| 2197800 | 6/1988 | United Kingdom | 446/370 |

*Primary Examiner*—Robert A. Hafer
*Assistant Examiner*—D. Neal Muir
*Attorney, Agent, or Firm*—Roy A. Ekstrand

[57] ABSTRACT

A torsional joint armature for poseable figure is formed of a one-piece molded plastic material fabricated from a malleable nonelastic deformable material. The armature is articulated by a plurality of molded joints each of which includes one or more torsional deformation elements to provide the appropriate bending characteristics of the armature. Certain joints are provided with additional motion limiting webs to restrict joint motion in undesired directions.

13 Claims, 2 Drawing Sheets

TORSIONAL JOINT SKELETON FOR POSEABLE FIGURE

FIELD OF THE INVENTION

This invention relates generally to articulated figures and particularly to those having a poseable characteristic.

BACKGROUND OF THE INVENTION

Articulated toy figures have been created for many years and have provided substantial entertainment and enjoyment for children. While a great number of articulated toy figure structures have been produced and their structures have varied greatly, they may be generally divided into two main groups. The first group utilizes a number of articulated limb and torso elements which are movably interconnected by hinge mechanisms of one type or another. The second group utilizes an armature which is covered over by a usually soft flexible outer skin and body covering. A number of different armature structures have been provided including flexible wire frames, rigid discrete elements interconnected by movable hinges and molded plastic armatures. In certain toy figure structures, attempts have been made to produce figures which are poseable. The poseable characteristic refers to the quality of the toy figure in which the limbs and torso may be moved to provide a desired figure position and maintain the desired position once the limbs have been released.

One such poseable structure is set forth in U.S Pat. No. 3,284,947 issued to Dahl which sets forth an ADJUSTABLE DOLL HAVING DEGASSED MALLEABLE CORE in which a metal armature having a plurality of inflexible skeletal elements is interconnected by a plurality of flexible malleable metal elements to form an armature. An outer skin and body is molded upon the armature to produce a poseable figure.

U.S. Pat. No. 1,595,203 issued to Leathers sets forth a TOY AND THE MANUFACTURE THEREOF in which a toy figure skeleton includes a plurality of relatively inflexible skeletal elements interconnected by metal hinge structures to provide skeletal articulation. The skeleton is covered by a layer of foam rubber, plastic, or the like to complete the toy figure structure.

U.S. Pat. No. 3,234,689 issued to Ryan sets forth a DOLL CONSTRUCTION FOR NATURAL MOVEMENTS AND POSITIONS in which a doll is formed of a plurality of molded plastic limbs and torso. The leg to hip joints of the doll include a interconnected hinge structure which provides a desired degree of motion between the leg members and the torso.

U.S. Pat. No. 4,062,144 issued to Holden et al. sets forth a FLEXIBLE DOLL HAVING ARM MEMBERS PIVOTABLE TO PLURAL STABLE POSITIONS in which a doll's construction includes a relatively flexible body having leg and arm members joined thereto. The arm members include a plurality of hingedly connected segments that are movable from a fully open to fully closed position. The poseable quality of the arm members arises due to the snap action of the hinge construction connecting the segments within the arm.

U.S. Pat. No. 4,197,358 issued to Garcia sets forth a FLEXIBLE STATUE in which a figure is provided which can be flexed into different animated positions. The figure includes a soft wire frame embedded within a body of flexible material. The flexible metal frame is secured to a supporting base by a plurality of fasteners and cooperating receptacles within the figure.

U.S. Pat. Nos. 164,582 issued to Miller, 1,626,533 issued to Hergershausen, 2,134,974 issued to Hurwitz, 2,219,130 issued to Herrmann, and 2,392,024 issued to Couri all set forth various doll and toy figure structures in which an internal malleable armature is embedded within a soft outer body and limb structure.

U.S Pat. No. 2,202,805 issued to Wood sets forth a DOLL OR DISPLAY FIGURE in which an internal armature is fabricated of a multiply looped serpentine armature formed of a sinuous wire is covered by a soft outer skin and body member.

U.S. Pat. No. 2,089,376 issued to Jacobson sets forth an INANIMATE FIGURE AND METHOD OF MAKING SAME in which a plurality of joints between skeletal members is formed of a sinuous wire interconnection surrounded by a molded plastic outer plastic body. U.S. Pat. Nos. 4,578,045 issued to Mayer et al., 2,482,334 issued to Fernald, and 2,909,370 issued to Fortney set forth various structures in which rigid body members are interconnected by articulated hinge structures.

While the foregoing described structures have enjoyed some success in providing usable toy figure and doll structures, they have yet to provide the degree of poseability desired in poseable figures. In addition, the prior art structures have here to date been relatively limited in their durability. Of particular concern in poseable structures is the short life of the hinge members due to the tendency of joint structures to fatigue when bent or deformed repeatedly.

There remains, therefore, a need in the art for a poseable figure having joint structures which while fully poseable are less subject to the destructive fatigue of malleable members heretofore encountered in poseable figures.

SUMMARY OF THE INVENTION

Accordingly, it is a general object of the present invention to provide an improved poseable figure. It is a more particular object of the present invention to provide an improved poseable figure utilizing an armature having therein malleable joint structures which are resistant to destructive fatigue.

In accordance with the present invention, there is provided for use in a poseable figure, an armature comprising: a plurality of generally rigid members; and a plurality of joints interconnecting selected ones of the rigid members to form an articulated armature in which each of the joints includes a torsionally deformable member for undergoing torsional deformation during pivotal motion of the rigid members.

BRIEF DESCRIPTION OF THE DRAWINGS

The features of the present invention, which are believed to be novel, are set forth with particularity in the appended claims. The invention, together with further objects and advantages thereof, may best be understood by reference to the following description taken in conjunction with the accompanying drawings, in the several figures of which like reference numerals identify like elements and in which:

DESCRIPTION OF THE PREFERRED EMBODIMENTS

Figure 1:
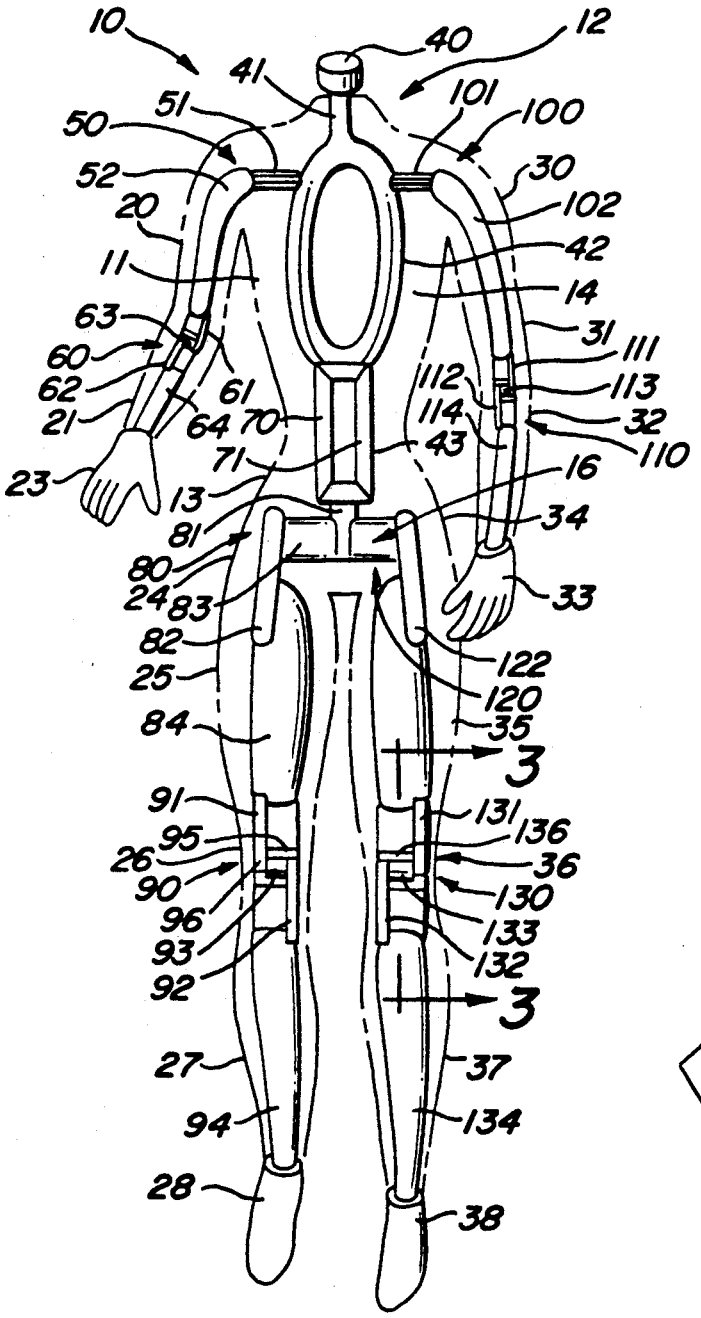
FIG. 1 is a front elevation view of a torsional joint armature for poseable figure constructed in accordance with the present invention.

FIG. 1 sets forth a front perspective view of a poseable figure constructed in accordance with the present invention and generally referenced by numeral 10. FIG. 10 comprises a molded plastic armature generally referenced by numeral 16 having molded therein a plurality of structural members connected by a plurality of joints fabricated in accordance with the present invention and described below in detail. FIG. 10 further includes an outer body and skin molded unit generally referenced by numeral 15 which in accordance with conventional molding techniques is preferably formed of a soft material such as foam, plastic, or rubber having an outer skin surface integral therewith.

Specifically, poseable FIG. 10 includes a torso 11 having connected thereto a neck 12 and a waist area 13. FIG. 10 further includes a right shoulder 20, a right arm 21, a right elbow 22, and a right hand 23. A right hip 24 is connected to waist 13 and a right thigh 25. A right knee 26 connects right thigh 25 to right lower leg 27. A right foot 28 is connected to lower leg 27.

Correspondingly, FIG. 10 includes a left shoulder 30, a left arm 31, a left elbow 32, and a left hand 33. A left hip 34 is connected to waist 13 and to a left thigh 35. A left knee 36 and a lower leg 37 are connected to left thigh 35 and to a left foot 38.

Poseable FIG. 10 is configured to resemble the human form and thus the foregoing described designations for the individual parts and members are utilized. However, it will be apparent to those skilled in the art that the present invention poseable figure many take different forms beyond the human form and may be used to simulate animal figures, mechanical apparatus such as androids or robots, and fanciful figures without departing from the spirit and scope of the present invention.

As mentioned, armature 16 is preferably formed of a single molded unit utilizing a generally inelastic material such as polybutylene terephthalate manufactured and sold by E. I. DuPont De Nemours & Co., Inc. under the trade name Rynite PBT. It will be recognized by those skilled in the art after the following descriptions, however, that other materials having similar characteristics may be used without departing from the spirit and scope of the present invention. Other methods of fabricating outer body 15 may be used in combination with the present invention armature.

Armature 16 includes a head attachment 40 constructed in accordance with conventional fabrication techniques having connected thereto a neck member 41. A chest member 42 having a generally elliptical shape is coupled to neck member 41. A waist member 43 included a pair of torsional waist elements 71 and 72 configured in general parallel configuration and attached to chest member 42. A coupling element 81 is connected to elements 71 and 72 to complete the torso and waist structure of armature 16.

Armature 16 includes a right shoulder joint 50 having an arm member 52 and a torsional element 51 coupling arm member 52 to chest member 42. In its preferred form, torsional element 51 as is better seen in FIG. 4 defines a cruciform cross sectional element. A right elbow joint 60 includes a coupling element 61 connected to arm member 52, a coupling element 62 coupled to arm member 64 and a torsional element 63 extending between elements 61 and 62. The structure of elbow joint 60 is set forth more clearly in FIG. 2. Arm member 64 is coupled to right hand 23 in a direct attachment.

A hip joint 80 includes a coupling element 82 and a torsional element 83. Torsional element 83 couples element 82 to element 81. A right thigh member 84 is connected to element 82. A right knee joint 90 includes a connecting element 91 coupled to thigh member 84, a coupling element 92 connected to a leg member 94, and a torsional element 93 coupled between elements 91 and 92. In its preferred form, knee joint 90 is similar in structure to elbow joint 60. Knee joint 90 further includes a web element 95 extending between torsional element 93 and element 91 and a limiting web member 96 extending between torsional element 93 and element 92.

Armature 16 further includes a left shoulder joint 100 having an arm member 102 and a torsional element 101. Joint 100 is virtually identical to shoulder joint 50. By further similarity, armature 16 includes a left shoulder joint 110 having elements 111 and 112 interconnected by a torsional element 113. Joint 110 is connected between arm member 114 and arm member 102. A left hip joint 120 is virtually identical to hip joint 80 and includes an element 122 connected to thigh member 124 and a torsional element 123 coupling element 122 to element 81. A knee joint 130 is virtually identical to knee joint 90 and includes a coupling element 131 connected to thigh member 124, a coupling element 132 connected to leg member 184, and a torsional element 133 coupled between elements 131 and 132. Knee joint 130 further includes a limiting web 135 coupled be&ween element 131 and torsional element 133 and a similar limiting web 136 coupled between element 132 and torsional element 133.

It should be noted that the structural details and operation of elbow joints 60 and 110 as well as knee joints 90 and 130 are set forth below in greater detail and shown in greater detail in FIG. 2. Similarly, hip joints 80 and 120 together with waist elements 70 and 71 and coupling element& 81 are shown and described in greater detail in connection with FIG. 5. Finally, shoulder joints 50 and 100 are set forth and described in greater detail in FIG. 4 below. However, suffice it to note here that armature 16 may preferably be formed of a single molded unit within which &he articulations of poseable FIG. 10 may be achieved in close correspondence to the articulations of an actual human form. Specifically, it will be noted that shoulder joints 50 and 100 provide the various motions of right arm 21 and left arm 31 respectively due to the ability of torsional elements 51 and 101 to provide the degree of flexing required to move arms 21 and 31 outwardly from torso 11. When so move, torsional elements 51 and 101 undergo flexing or bending in a generally curved manner. Of particular importance to the present invention, however, is the operation of torsional elements 51 and 101 when arms 21 and 31 are moved in a pivotal manner about their respective shoulder joints such as occur when arms 21 and 31 are extended rearwardly or forwardly. As is shown more clearly in FIG. 4, the forward and rearward mo&ion of arms 21 and 31 causes torsional elements 51 and 101 to undergo a torsional or twisting deformation which has been particularly hard to provide in prior art structures. In accordance with the invention, the pivoting actions of arms 21 and 31 are taken up entirely by the torsional deformation of torsional elements 51 and 101. As a result, the torsional stress is distributed more or less uniformly through torsional elements 51 and 101 which significantly lengthens the usable life of armature 16.

As mentioned, elbow joints 60 and 110 and knee joints 90 and 130 are virtually identical in structure which is described below in greater detail in FIG. 2. Suffice it to note here, however, that the structures of elbow joints 60 and 110 and knee joints 90 and 130 provide the desired degrees of motion very similar to those of the human form. Specifically, torsional elements 63, 113, 93, and 133 provide extremely limited degrees of motion in directions other than those directions of motion which provide torsional deformation of their torsional elements. Thus with respect to elbow joint 60, for example, torsional element 68 permits very limited degrees of motion of arm members 52 and 64 in side to side fashion due to the linkages provided by webs 65 and 66 (better seen in FIG. 2). Thus the operation of limiting webs 65 and 66 prohibits elbow joint 60 from undergoing unnatural motion and provides better replication of the human form. The bending motions of arm 21, however, which are characteristic of the elbow motion of a human form cause a torsional deformation of torsional element 63 which is twisted as elements 61 and 62 are moved in a pivotal or rotational manner typical of human arm movement. Once again, the torsional characteristic of torsional element 63 provides an even distribution of the torsional stress imposed upon elbow joint 60 and provides ex&ended life of armature 16. Similar operation is provided by elbow joint 110 and knee joints 90 and 130.

Waist elements 70 and 71 couple hip joints 80 and 120 to chest member 42. Waist elements 70 and 71 undergo a twisting deformation whenever torso 11 is twisted with respect to hips 24 and 34 of FIG. 10. The operation of hip joints 80 and 120 is virtually identical in that the outward motions of thighs 25 and 35 in a "sidekick" type motion produce curved bending deformations of torsional elements 83 and 123. In the event thighs 25 or 35 are moved forward and back pivoting about hips 24 and 34 respectively, torsional elements 83 and 123 undergo torsional or twisting deformation. Once again, the torsional action of torsional elements 83 and 123 provides a substantially even distribution of torsional stress within each of the torsional elements which avoids the damaging fatigue which would otherwise shorten the life of armature 16 in prior art structures during such motion.

Figure 2:
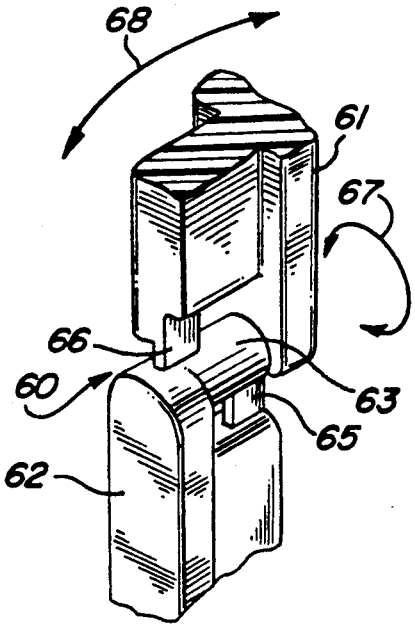
FIG. 2 is a perspective view of a typical joint from the armature in FIG. 1.

FIG. 2 sets forth a perspective view of right elbow joint 60. As mentioned, left elbow joint 110 as well am knee joints 90 and 130 are similarly structured to elbow joint 60. Accordingly, the descriptions which follow in connection with FIG. 2 applies equally well to these joints. Accordingly, right elbow joint 60 include a generally T-shaped rigid element 61 and a similar generally T-shaped rigid element 62. A generally cylindrical torsional element 68 is coupled transversely between rigid elements 61 and 62. A connecting web 65 extends between coupling element 62 and torsional element 63. A similar connecting web 66 extends between element 61 and torsional element 68. In the position shown in FIG. 2, joint 60 is in the relaxed or straight line position in which no torsional deformation of torsional element 63 is provided. In order to more closely duplicate the degrees of motion of the human form, it is desirable that joint 60 be very resistant to motion from side to side such as the motion of element 61 with respect to element 62 in the directions transverse to joint 60 shown by arrow 68. These side to side motions are resisted by webs 65 and 66 which provide limiting elements acting to restrict the curved bending of torsional element 63. Thus motions in the directions indicated by arrows 68 are resisted by webs 65 and 66. Conversely, in the desired directions of joint motion in which elements 61 and 62 are pivoted with respect to each other in the manner indicated by arrows 67, torsional element 63 undergoes torsional deformation with the relative twisting or pivotal motion between elements 61 and 62. Since torsional element 63 undergoes generally uniform torsional deformation, the life of joint 60 is substantially increased over the prior art structures. During pivotal or torsional motion, webs 65 and 66 because of their relatively thin cross sections are easily bent to accommodate the pivotal motions of elements 61 and 62 and thus are not operative to limit in any significant sense the degrees of motion of joint 60. This of course more closely replicates the degrees of motion of the human form at elbow and knee joints which of course is the desired result. In accordance with an important aspect of the present invention, the fabrication of armature 16 from inelastic materials such as the material set forth above permits torsional element 63 to be torsionally deformed by the motion of elements 61 and 62 in a poseable manner in which no restoring force of return tendency of torsional element 63 is produced.

Figure 3:
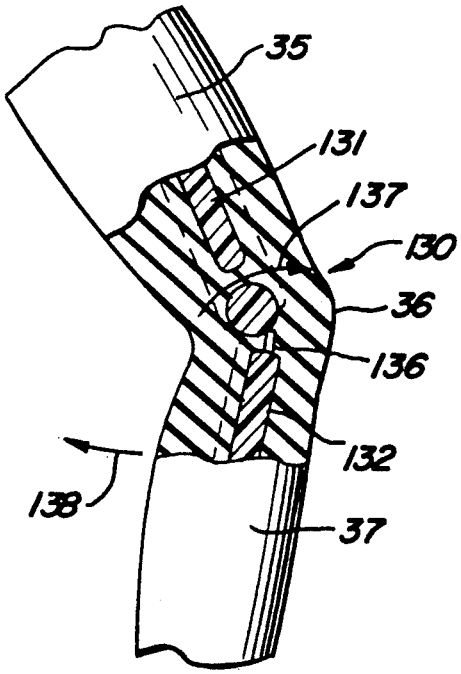
FIG. 3 is a partial section view of a portion of the armature of FIG. 1 taken along section lines 3—3 therein.

FIG. 3 sets forth a partially sectioned view of knee joint 130 shown in a partially flexed or bent position. Thus, left thigh 35, left knee 36, and lower leg 37 are shown in a partially bent or flexed position resulting from the pivotal motion of lower leg 87 with respect to thigh 35 in the direction indicated by arrow 138. Knee joint 130 includes a generally T-shaped element 131 and a similar T-shaped element 132. A generally cylindrical cross sectional torsion element 133 extends between elements 131 and 132. In addition, a limiting web 136 extends between torsional element 133 and coupling element 132. As is better seen in FIG. 1, knee joint 130 further includes a second limiting web 135 coupled between torsional element 133 and element 131. The bending or pivoting motion of lower leg 37 in the direction indicated by arrow causes a corresponding pivotal motion of element 132 with respect to element 131. Such pivotal motion imposes a torsional force upon torsion element 133 in the direction indicated by arrow 137. Because of the above-described readily deformable characteristic of torsional element 133, the entire bending deformation of knee joint 130 is taken up by the torsional deformation of torsion element 133. Once again, because the torsional deformation of torsion element 133 is generally uniformly distributed throughout the entire element, the poseability and long life of armature 16 is greatly enhanced.

Figure 4:
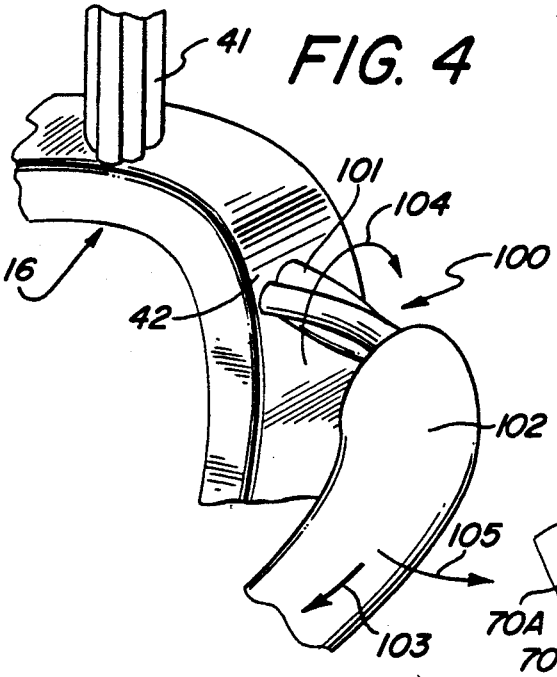
FIG. 4 is a perspective view of the shoulder joint portion of the armature of FIG. 1.

FIG. 4 sets forth a partial perspective view of the left shoulder portion of armature 16. Armature 16 includes a generally elliptical chest member 42 and an upwardly extending neck member 41. A left arm member 102 is coupled to chest member 42 by a torsional element 101. Torsional element& 101 is formed in a cruciform cross section to improve its torsional deformation characteristics. Accordingly, arm member 102 is coupled to chest member 42 solely by torsional element 101 to form shoulder joint 100. As described above, motion of arm member 102 directly outwardly from chest member 42 in the direction indicated by arrow 105 causes torsional element 101 to undergo a curved bending deformation. In contrast, pivotal motion of arm 102 about shoulder joint 100 in the direction indicated by arrow 103 causes a torsional deformation of torsion element 101 in the direction indicated by arrow 104. The torsional characteristics of torsion element 101 permit a distributed torsional deformation of the torsional element which provides for the desired degree of motion of arm member 102. It has been found that the cruciform cross section of torsion element 101 provides better torsional deformation characteristics and extended useful life of shoulder joint 100.

Figure 5:
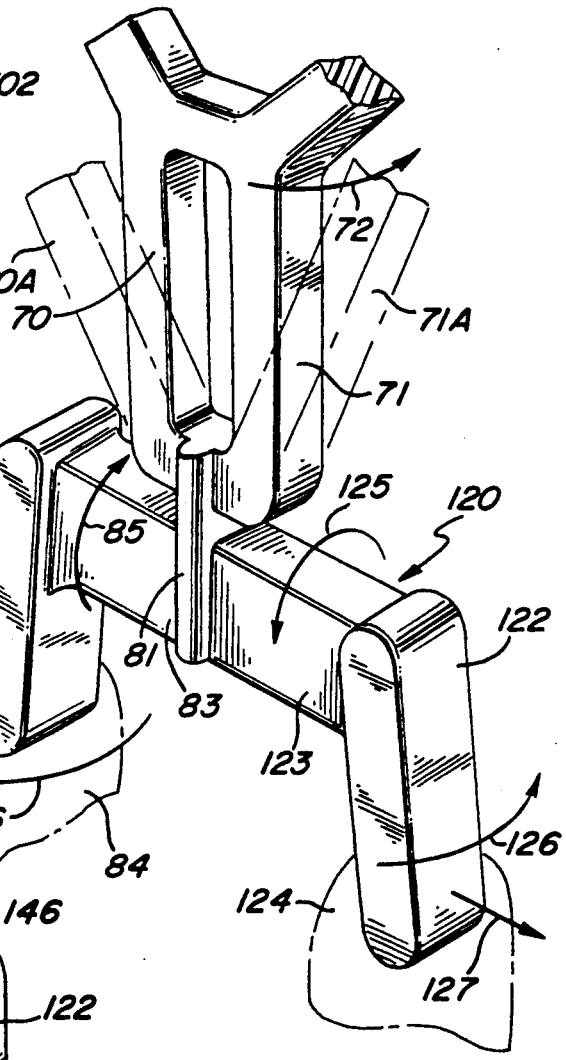
FIG. 5 is a perspective view of an alternate embodiment of the present invention armature.

FIG. 5 sets forth the waist and hip joint portions of armature 16. Elements 70 and 71 are formed in a generally parallel arrangement and commonly coupled to a coupling element 81. A hip joint 80 includes a coupling element 82 connected to thigh member 84 and a torsional element 83 coupling element 82 to element 81. Similarly, a hip joint 120 includes a coupling element 122 connected to a thigh member 124 and a torsional element 123 coupled between element 122 and element 81.

Elements 70 and 71 are configured to provide a twisting action for waist 13 (see FIG. 1). Thus in the event torso 11 is twisted with respect to hips 24 and 34 (see FIG. 1), the twisting motion is accommodated by the motions of elements 70 and 71. For example, in the event a twisting motion in the direction of arrow 72 is undertaken, elements 70 and 71 are twisted from their parallel arrangement shown in FIG. 5 in solid line form to the dashed line positions shown as elements 70A and 71A. During this motion, elements 70 and 71 undergo torsional deformation which is distributed along the entire lengths of elements 70 and 71.

With respect to hip joint 80, the outward motion of thigh member 84 in the direction indicated by arrow 87 causes torsional element 83 to undergo nontorsional curved bending. Conversely, the pivotal motion of thigh member 84 in the direction indicated by arrow 86 causes a torsional deformation of torsional element 83 in the direction indicated by arrow 85. Torsional element 83 is constructed in a generally rectangular cross section form and provides a generally uniform torsional deformation during pivotal motion of thigh member 84. Similarly, with respect to hip joint 120, the outward motion of thigh member 124 in the direction indicated by arrow 127 provides bending deformation of torsional element 123. Conversely, pivotal motion of thigh member 124 about hip joint 120 in the direction indicated by arrow 126 causes a corresponding torsional deformation of torsion element 123 in the direction indicated by arrow 125. Torsion element 123 has a rectangular cross section identical to torsion element 83 and provides the same generally uniform torsional deformation as torsional element 83. Once again because torsion elements 83 and 123 are formed of a readily deformable nonelastic material such as that set forth above, hip joints 80 and 120 provide a poseable characteristic.

Figure 6:
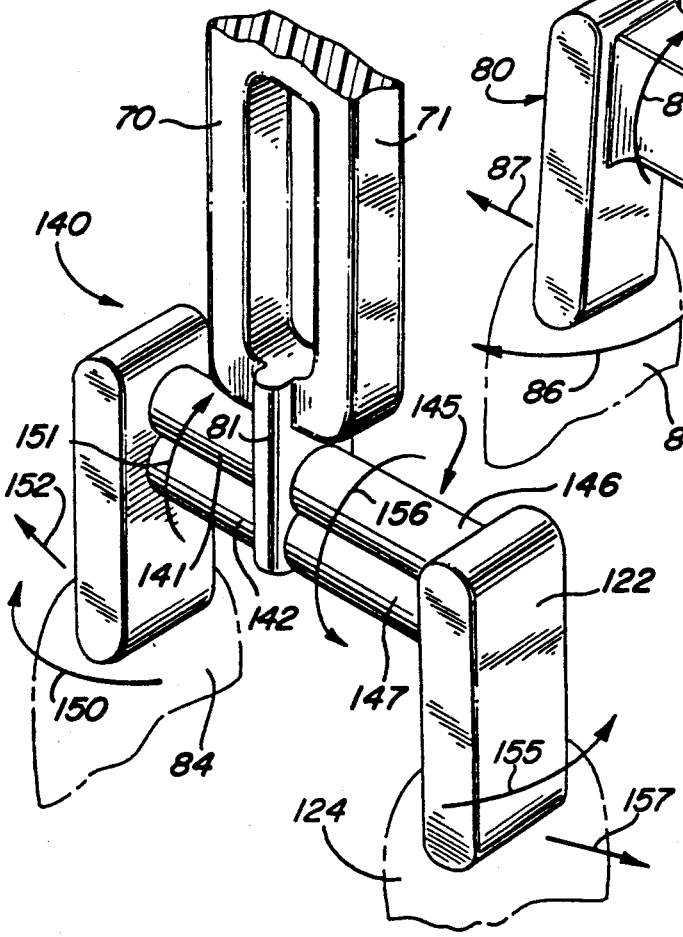
FIG. 6 is a perspective view of a further alternate embodiment of the present invention armature.

FIG. 6 sets forth a perspective view of an alternate embodiment of the hip joint portions of the present invention poseable figure. Elements 70 and 71 are coupled to element 81 in accordance with the above-described embodiments. By further similarity, element 82 is coupled to thigh member 84 and element 122 is coupled to thigh member 124 in accordance with the above-described structures. Hip joint !40 includes a pair of generally cylindrical parallelly arranged torsional elements 141 and 142 coupled between element 82 and common element 81. Similarly, joint 145 includes a pair of generally cylindrical cross section parallelly arranged torsion elements 146 and 147 coupled between element 122 and common element&81. In operation, motion of thigh member 84 outwardly in the direction indicated by arrow 152 causes torsion elements 141 and 142 to undergo a bending deformation. Conversely, pivotal motion of thigh member 84 in the direction indicated by arrow 150 causes a torsional deformation of torsion elements 141 and 142 in the direction indicated by arrow 151. In contrast &o the above-described embodiment, however, torsion elements 141 and 142 are, in addition to their respective axial torsion deformations, subjected to a twisting or winding deformation about each other. This additional deformation enhances the torsional characteristics of joint 140 and further increases the poseability and useful life of joint 140. Similarly, with respect to joint 145, outward motion of thigh member 124 in the direction indicated by arrow 157 produces curved bending of torsion elements 146 and 147. Pivotal motion of thigh member 124 in the direction indicated by arrow 155 causes a corresponding torsional deformation of elements 146 and 147 in the direction indicated by arrow 156. In similarity to torsional elements 141 and 142, torsion elements 146 and 147 undergo their respective torsional deformations as well as &he twisting or winding deformation about each other described above. As a result, joint 145 exhibits the improved poseability and extended life provided for joint 140.

It should be apparent to those skilled in the art that the above-described pivotal motions shown in FIGS. 4 through 6 apply equally well to pivotal motion of each respective member in the opposite direction as well.

What has been shown in an improved torsional joint armature for poseable figure in which the pivotal forces imposed upon the joint members are accommodated by torsion elements having a generally uniform torsion deformation characteristic to provide improved poseability and extended life for the armature.

While particular embodiments of the invention have been shown and described, it will be obvious to those skilled in the art that changes and modifications may be made without departing from the invention in its broader aspects. Therefore the aim in the appended claims is to cover all such changes and modifications as fall within the true spirit and scope of the invention.

What is claimed is:

1. For use in a poseable figure, an armature comprising:

a plurality of generally rigid members;

a plurality of joints interconnecting selected ones of said rigid members to form an articulated armature, each of said joints including a substantially perpendicular torsion absorbing member for undergoing torsional deformation during relative pivotal motion of said rigid members interconnected by the torsion absorbing member; and web portions attaching said torsion absorbing member to said rigid members and retaining said torsion absorbing member in a substantially perpendicular attitude, whereby said torsion absorbing member retains the angular position of said rigid members set by a user.

2. An armature as set forth in claim 1 wherein said torsionally deformable members define generally cylindrical cross sections.

3. An armature as set forth in claim 1 wherein said torsionally deformable members define generally rectangular cross sections.

4. An armature as set forth in claim 1 wherein said torsionally deformable members define generally cruciform cross sections.

5. An armature as set forth in claim 1 wherein said rigid members each define end portions and wherein said torsionally deformable members are coupled between said end portions of pairs of said rigid members.

6. An armature as set forth in claim 5 wherein said joints further include motion limiting web members further coupling said torsionally deformable members to said end portions.

7. For use in a poseable figure, an armature joint comprising:

first and second generally parallel rigid members having respective first and second end portions; and a first torsion absorbing coupling element coupled between said first and second end portions extending generally perpendicular to said first and second rigid members; and web portions attaching said torsion absorbing coupling element to said first and second end portions to maintain the relative perpendicularity between said torsion absorbing coupling element and said first and second rigid members;

whereby said torsion absorbing coupling element retains the angular position of said first and second rigid members set by a user.

8. An armature joint as set forth in claim 7 wherein said first torsionally deformable coupling element defines a generally cylindrical cross section.

9. An armature joint as set forth in claim 7 wherein said first torsionally deformable coupling element defines a generally rectangular cross section.

10. An armature join& as set forth in claim 7 wherein said first torsionally deformable coupling element defines a generally cruciform cross section.

11. An armature joint as set forth in claim 7 further including a second torsion absorbing element coupled between said first and second end portions and being generally adjacent and parallel to said first torsion absorbing element, said first and second torsion absorbing elements being joined to each other along their respective lengths winding about each other during pivotal motion of said first rigid member with respect to said second rigid member.

12. An armature joint as set forth in claim 7 further including first and second motion limiting web members extending between said respective first and second end portions and said torsionally deformable element.

13. For use in a poseable figure, an armature joint comprising:

first and second generally parallel rigid members having respective first and second end portions; and first and second generally adjacent and parallel torsion absorbing coupling elements coupled between said first and second end portions extending generally perpendicular to said first and second rigid members, said first and second torsionally deformable elements being joined to each other along their respective lengths winding about each other during pivotal motion of said first rigid member with respect to said second rigid member.

* * * * *